United States Patent [19]

Vaseen

[11] 4,226,683

[45] Oct. 7, 1980

[54] METHOD AND APPARATUS FOR HYDROGEN PRODUCTION IN AN ABSORBER LIQUID BY ELECTROCHEMICAL OF COAL AND WATER

[76] Inventor: Vesper A. Vaseen, 9840 W. 35th Ave., Wheatridge, Colo. 80033

[21] Appl. No.: 65,210

[22] Filed: Aug. 9, 1979

[51] Int. Cl.[3] ..... C25B 1/02; C25B 1/00

[52] U.S. Cl. ..... 204/101; 204/129

[58] Field of Search ..... 204/129, 101

[56] References Cited

U.S. PATENT DOCUMENTS 4,043,881 8/1977 Yen et al. ..... 204/101

*Primary Examiner*—R. L. Andrews

[57] ABSTRACT

Coal and carbon particulates or dust when mixed with water through which a direct electric current passes, electrochemically react reducing the water to hydrogen and the coal to carbon dioxide. By washing the electrodes with an inert dielectric liquid the gases as formed are mechanically washed from both the anode and cathode electrodes and subsequently absorbed by the liquid thus more efficiently keeping the chemical reaction proceeding to the right. By using a liquid dielectric capable of operating under elevated temperatures and superatmospheric pressures the chemical reactions proceed at a much greater rate than at atmospheric and ambient conditions. This disclosure teaches the art and science of producing hydrogen by reacting coal or carbon dust with hot water retained as water by superatmospheric pressure. The pressure controlled by the use of an inert dielectric liquid which washes the electrodes and while doing so depolarizes them by absorption of the gases. Gases are recovered from the absorber liquid for use.

1 Claim, 2 Drawing Figures

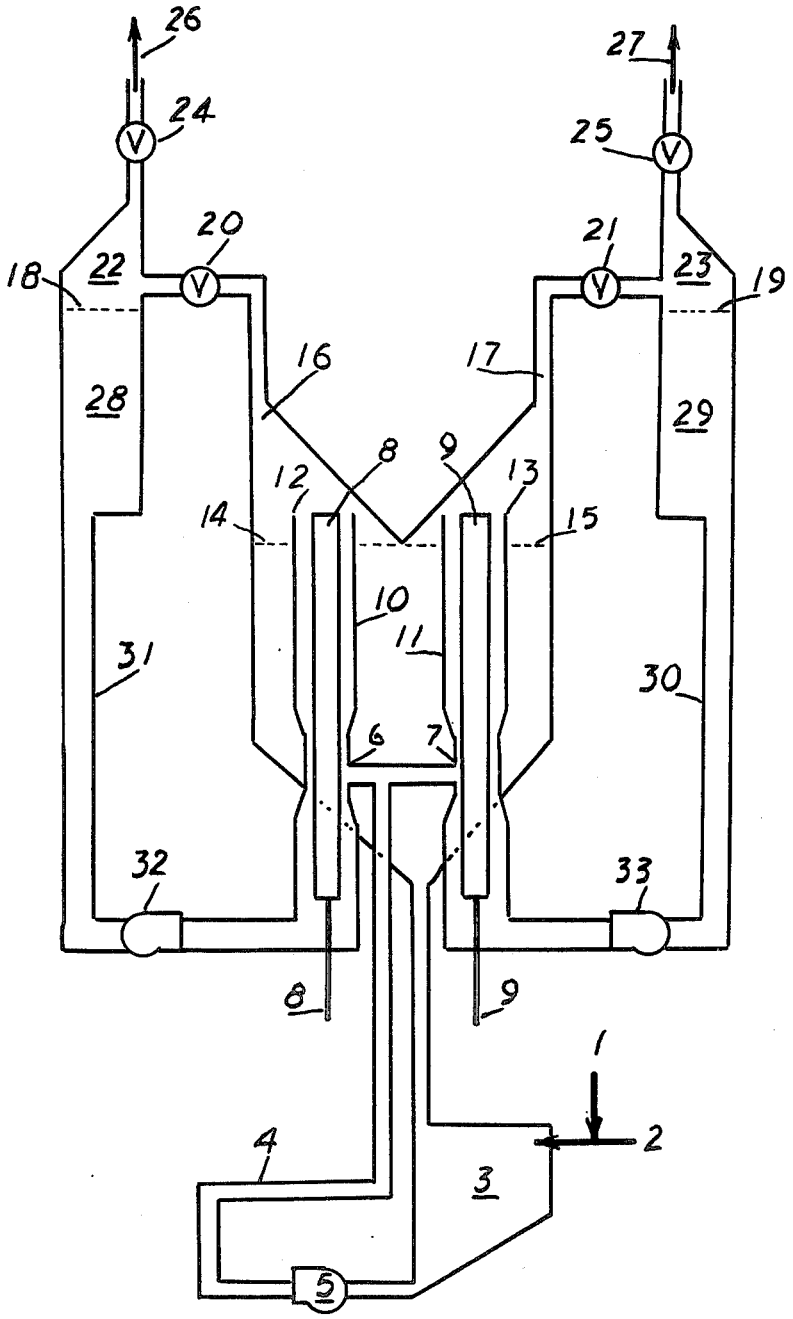
FIG - II

METHOD AND APPARATUS FOR HYDROGEN PRODUCTION IN AN ABSORBER LIQUID BY ELECTROCHEMICAL OF COAL AND WATER

HISTORICAL AND DESCRIPTION OF PRIOR ART

Electrolysis of water follows the law of electrolysis which states: If a current (i) flows for a period of time (t) and deposits a metal whose electrochemical equivalent is (e), the mass deposited is m=eit. (Normally the value of e is given for mass in grams and i in amperes with time (t) in seconds).

Water requires a theoretical thermodynamic electrical energy input ($F^\circ = rFE^\circ$) of 56.7 kcal per mol of hydrogen when using a voltage of 1.23.

Thermodynamic electrical energy for electrochemically reacting carbon dust with water as per the equation:

$$\underset{\text{(Solid)}}{C} + \underset{\text{(Liquid)}}{2H_2O} = \underset{\text{(Gas)}}{2H_2} + \underset{\text{(Gas)}}{CO_2}$$

The theoretical electrical energy required is 9.5 kcal at 0.21 volts when producing one (1) mol of hydrogen.

Production of hydrogen from water has been up till this disclosure the reaction of coal at 800° C.± and steam which produced various combination of synthesis gases.

Prior to this disclosure it has not been possible to consider the electrochemical reaction of coal or carbon and water due to the slowness of the reaction — at ambient temperature and atmospheric pressure; along with the problem of recovery of gases collected at the electrodes in a hot water system which flashes to steam at reduced operating pressures.

No actual prior art exists for operating an electrolysis cell containing coal dust and water as the reactants, along with an inert dielectric gases absorber liquid.

REFERENCES:

U.S. PAT. NOS.

| | | | |
|---|---|---|---|
| 341,727 | 5/1886 | Cabell | 210/243 |
| 1,056,043 | 3/1913 | Morrison | 55/3 |
| 1,056,244 | 3/1913 | Wiley | 55/68 |
| 1,722,458 | 7/1929 | DeBaupre | 55/68 |
| 3,177,633 | 4/1965 | McDonald, Jr. | 55/3 |
| 3,762,133 | 10/1973 | Merriman, et. al. | 55/36 |
| 4,049,398 | 9/1977 | Vaseen | 55/36 |

U.S. PAT. NOS. APPLICATIONS

| | | |
|---|---|---|
| 940,904 | 9/11/78 | Vaseen |
| 004,067 | 01/17/79 | Vaseen |
| 030,306 | 04/10/79 | Vaseen |
| 044,966 | 6/4/79 | Vaseen |
| 044,963 | 6/4/79 | Vaseen |

SUMMARY

The electrochemical breakdown of water to hydrogen is assisted and has less energy demand when an oxygen recipient such as carbon is available. Chemical reactions proceed more efficiently with conditions of superatmospheric pressure, elevated temperature and small size or greater surface area of solids type chemical reactants.

This disclosure teaches thg$krt and science of conducting these electro chemical processes in a manner which is conducive of controlling temperature and pressure as well as insuring adequate electrode area is actively able to transfer electrons in the system.

The process is preferably conducted at a superatmospheric pressure which in conjunction with the operating temperature retains the water in the system in a liquid water state.

The water slurry is made alkaline or acidified sufficiently to allow a flow of current across the electrolyte from electrode to electrode. Coal (1) or any carbon in a finely divided state, such as dust, is mixed with water (2) to form a slurry, preferably as a suspension of carbon particulates in water. This slurry or suspension is transferred (5) from a constant pressure reservoir (3) through a piping system (4) into the electro chemical reaction cell (41) and is preferably supplied to the electrodes (8)(9) by way of a conductor (10)(11) in which is installed a venturi or injection devise (6)(7) where it is caused to move in concert with the absorber liquid along the downstream length and width of the electrodes (8) (9). The electrodes are provided a direct power input of not less than 9.5 kcal per mol of hydrogen being produced as compared with 56.7 kcal for normal electrolysis of water. The flow of carbon and water along the electrodes along with the current flow produced by a voltage in excess of 0.21 per mol of hydrogen; will cause hydrogen to attempt to collect on the anode. In order to depolarize the electrodes and its cause of reduction of current thus increased voltage flow with resultant reduced gases production an inert dielectric liquid is also caused to intermittently flow along with the coal slurry along the electrodes. The dielectric liquid is selected from among many which have a high affinity for absorbing gases. The absorbent being now nonmiscible with the water and selected with a greater density than that of water, separates from the water. The water/coal slurry from the anode, floating (38) on the absorber liquid, now pregnant with carbon dioxide, on the anode (8) side. The water/coal slurry from the cathode floating (39) on the absorber liquid, now pregnant with hydrogen on the cathode (9) side. Thus forming an interface (18) between the water/coal slurry and the absorber on the anode side, and a similar interface (19) between the water/coal slurry and the absorber liquid on the cathode side.

The absorber liquid (16) pregnant with carbon dioxide collected off the anode electrode (8) is transferred (51) through a flow and pressure control valve (20) to a carbon dioxide gas stripper (49) vessel.

The absorber liquid (17) pregnant with hydrogen collected off the cathode electrode (9) is transformed (52) through a flow and pressure control valve (21) to a hydrogen gas stripper (50) vessel.

Reduction in system pressure on the carbon dioxide stripper vessel (49) brought about by release of the carbon dioxide gas at pressure control valve (24) and in concert with absorber liquid transfer pump (32) returning carbon dioxide stripped absorber liquid for recycle use; releases the absorbed carbon dioxide from the absorber liquid pregnant with carbon dioxide collected in the stripper reservoir (47) and collects it above the liquid (22).

Reduction in system pressure on the hydrogen stripper vessel (50) brought about by release of the hydrogen gas at pressure control valve (25) and in concert with absorber liquid transfer pump (33) returning hydrogen stripped absorber liquid for recycle use; releases the absorbed hydrogen from the absorber liquid pregnant with hydrogen collected in the stripper reservoir (48) and collects it above the liquid (23).

A superatmospheric pressure is maintained by transfer pumps for the absorber liquid (32)(33) and coal slurry transfer pumps (42) in concert with their respective flow and pressure control valves (42)(43)(44)(34)(35)(24)(25)(20)(21) on both the anode (8) and cathode (9) sides of the electro chemical cell (41) which in concert with the temperature of operation maintains the coal/water slurry as water above the anode (38) and cathode (39).

Temperature is adjusted and controlled by adding or subtracting heat with a heater or heat exchanger (58). A heat exchanger is shown in the coal/water slurry system, but is also viable for installation in the absorber liquid piping system as well (not shown).

The carbon dioxide gas (22) as collected above the absorber liquid (47) by the reduced pressure in the carbon dioxide gas stripper vessel (49) is removed from the anode system by releasing it through a valve (24) either wasting it to atmosphere or using it for industrial use.

The hydrogen gas (23) as collected above the absorber liquid (46) by the reduced pressure in the hydrogen gas stripper vessel (50) is recovered for use from the cathode system by releasing it through valve (25) to use.

The rate of flow of the coal/water slurry to the anode is adjusted by flow control valve (34) so as to be in concert with the production of carbon dioxide and intermittent flow of absorber liquid from transfer pump (32) as well as with the rate of flow of the coal/water slurry to the cathode which is adjusted by flow control valve (35) and absorber liquid as transferred by pump (33).

The coal or carbon dust not reacted with the water the first cycle through the process apparatus is returned to the slurry reservoir (3) for recycle thus all carbon is eventually consumed in the process. All coal and some other carbon particulates contain non reactive compounds, such as ash. A "blowdown" of the settled materials in the slurry reservoir (3) is used to remove these materials from time to time. The bottom (55) of the coal water slurry reservoir collects this material which is removed or "blown down" by removal at valve (56).

Carbon dioxide gas freed at the anode and not absorbed is collected above interface (59) and released from the system by valve (63). Hydrogen gas freed at the cathode and not absorbed is collected above interface (60) and recovered for use through valve (64).

The absorbent liquid is any of many inert dielectric liquids which are commercially available and have general chemical/physical characteristics as follows:

1. Nominal boiling point several times that of water
2. Specific gravity either less than or greater than water. (Drawing shows a specific gravity greater than water) (This can be reversed).
3. For practical purposes — non volatile
4. Critical temperature several times that of boiling water at atmosphere
5. Non-miscible with water
6. Non-toxic to bio-organisms (including man).
7. Stable physical and chemical conditions at operation temperatures and pressures parameters.
8. Reusable for adinfinitum times
9. Non bio-degradable
10. Non-oxidizable with ozone
11. Non flammable
12. Have an affinity for absorbing gases Of the many liquids available the fully halogenated hydrocarbons are preferable.

FIG. I—Absorber Liquid Specific Gravity Greater than Water

DESCRIPTION OF DRAWING

1. Coal (Carbon) dust
2. Make up water
3. Coal (Carbon) slurry reservoir
4. Discharge piping for coal slurry to cell
5. Transfer pump for coal (Carbon) slurry
6. Ejector or mixer entry for introducing inert absorber liquid to anode
7. Ejector of mixer entry for introducing inert absorber liquid to cathode
8. Anode
9. Cathode
10. Conductor for coal (Carbon) slurry contact with anode
11. Conductor for coal (Carbon) slurry contact with cathode
12. Conductor for slurry and absorber liquid overflow
13. Conductor for slurry and absorber liquid overflow
14. Interface level between coal (Carbon) slurry on top and below the inert absorber liquid pregnant with $CO_2$ from anode
15. Interface level between coal (Carbon) slurry on top and below the inert absorber liquid pregnant with $H_2$ from cathode
16. Absorber liquid, pregnant with $CO_2$
17. Absorber liquid, pregnant with $H_2$
18. Interface between gaseous $CO_2$ and absorber liquid
19. Interface between gaseous $H_2$ and absorber liquid
20. Pressure relief and flow control valve for transfer of absorber liquid pregnant with $CO_2$
21. Pressure relief and flow control valve for transfer of absorber liquid pregnant with $H_2$
22. Gaseous $CO_2$ stripped from absorber liquid due to lowered pressure by valve (20) and release valve (24)
23. Gaseous $H_2$ stripped from absorber liquid due to lowered pressure by valve (21) and release valve (25)
24. Release valve to remove gaseous $CO_2$ from stripper
25. Release valve to remove gaseous $H_2$ from stripper
26. $CO_2$ as released to atmosphere or use
27. $H_2$ as released to atmosphere or use
28. Absorbant liquid reservoir for recovered liquid stripped of $CO_2$
29. Absorbant liquid reservoir for recovered liquid stripped of $H_2$
30. Absorbant liquid recycle to system
31. Absorbant liquid recycle to system
32. Transfer pump for recycle of absorbant liquid from $CO_2$ stripped liquid reservoir to system
33. Transfer pump for recycle of absorbant liquid from $H_2$ stripped liquid reservoir to system
34. Flow and pressure control valve for absorbant liquid into injector/mixer at anode
35. Flow and pressure control valve for absorbant liquid into injector/mixer at cathode
36. Conductor mechanism retaining coal (Carbon) and water slurry mixed with absorber liquid adjacent to anode
37. Conductor mechanism retaining coal (Carbon) and water slurry mixed with absorber liquid adjacent to cathode 38. Spent coal (Carbon)/water slurry remaining after electro-chemical reaction of "C" at anode
39. Spent coal (Carbon)/water slurry remaining after electro-chemical reaction of "C" at cathode
40. Separator between anode and cathode side of electrolytic cell
41. Electrolytic cell retainer vessel
42. Pressure and flow control valve for transfer of coal (Carbon) slurry to cell
43. Pressure and flow control valve for transfer of proportionate flow of coal (Carbon) slurry to anode (8) conductor (36)
44. Pressure and flow control valve for transfer of proportionate flow of coal (Carbon) slurry of cathode (9) conductor (37)
45. Separator in $CO_2$ stripper retaining integrity of $CO_2$ pregnant absorber liquid (47) from $CO_2$ stripped liquid reservoir (28)
46. Separator in $H_2$ stripper retaining integrity of $H_2$ pregnant absorber liquid (48) from $H_2$ stripped liquid reservoir (29)
47. Absorber liquid pregnant with $CO_2$ being stripped of absorber $CO_2$ by the reduction in system pressure at valve (20)
48. Absorber liquid pregnant with $H_2$ being stripped of absorbed $H_2$ by the reduction in system pressure at valve (21)
49. Stripper vessel for $CO_2$ removal from production system
50. Stripper vessel for $H_2$ removal from production system
51. Absorber liquid transfer pump from electro-chemical cell (41), to $CO_2$ stripper (49)
52. Absorber liquid transfer pump from electro-chemical cell (41) to $H_2$ stripper (50)
53. Coal (Carbon) dust feed system pressurizing feed to match system pressure integrity at slurry reservoir (3)
54. Make up water feed system to replace water electrochemically converted to $H_2$ and $O_2$ ($CO_2$) and match system pressure integrity at slurry reservoir (3).
55. Inert mineral settling zone for separating inert material from coal (Carbon) slurry
56. Inert minerals "blowdown" or periodic removal mechanism for removal out of system.
57. Transfer pump—for spent coal (Carbon) slurry back to reservoir (3).
58. Heater/temperature controller
59. Interface between gaseous $CO_2$ and water
60. Interface between gaseous $H_2$ and water
61. $CO_2$ gas liberated and not collected by absorber liquid
62. $H_2$ gas liberated and not collected by absorber liquid
63. $CO_2$ release valve
64. $H_2$ release valve
65. $CO_2$ to use or atmosphere
66. $H_2$ to use FIG. II—Absorber Liquid Specific Gravity Less than Water

DESCRIPTION OF DRAWING

Figure 1:
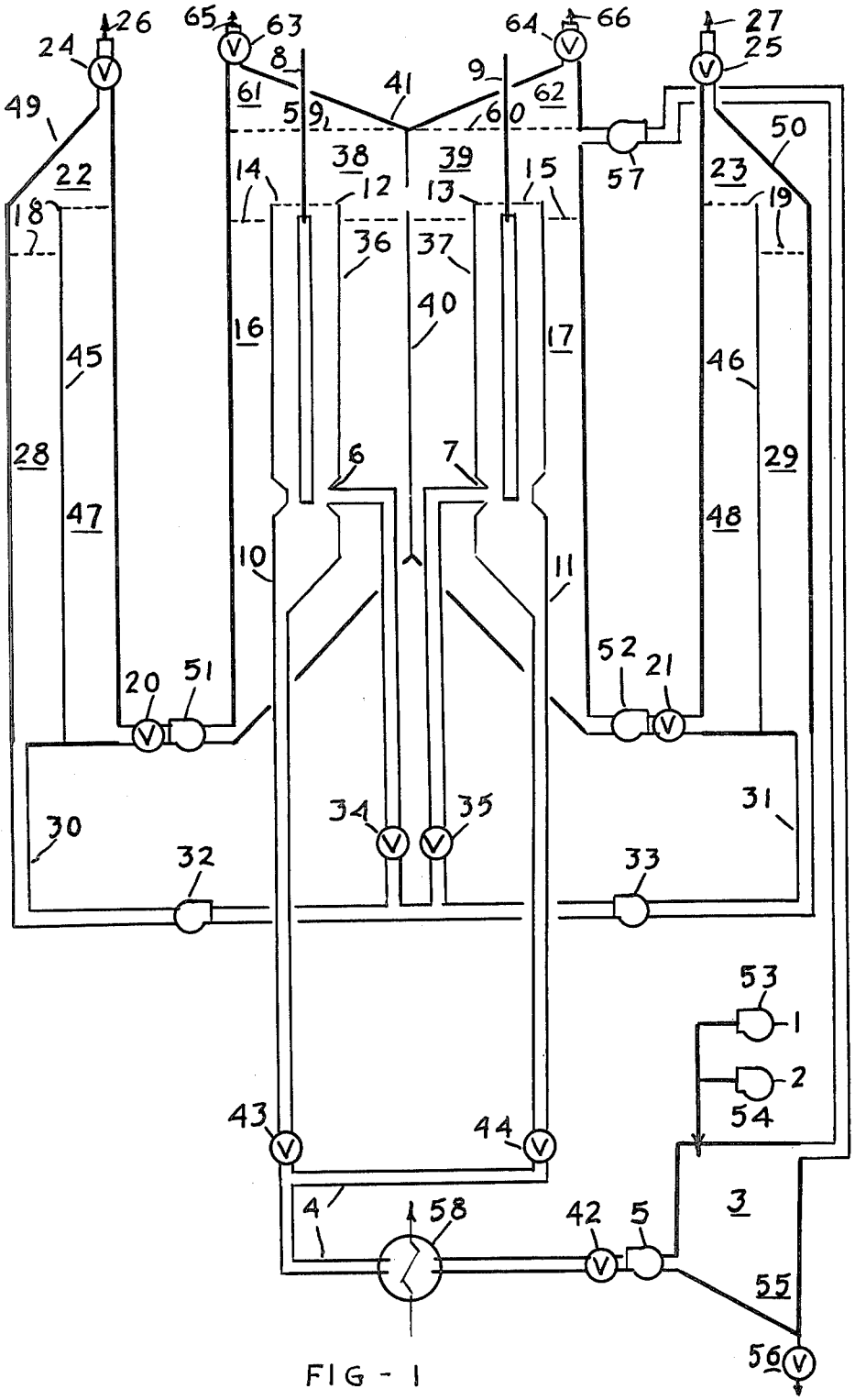

1. Coal (Carbon) Dust
2. Make up Water
3. Coal (Carbon) Slurry Reservoir
4. Discharge Pipe for Coal (Carbon) Slurry to Electrochemical Cell
5. Transfer Pump for Slurry
6. Ejector Influent Entry for Introducing Slurry to Anode
7. Ejector Influent Entry for Introducing Slurry to Cathode
8. Anode
9. Cathode
10. Slurry Conductor by Anode
11. Slurry Conductor by Cathode
12. Anode Slurry Conductor Overflow
13. Cathode Slurry Conductor Overflow
14. Interface Between Slurry and $CO_2$ Absorber Liquid
15. Interface Between Slurry and $H_2$ Absorber Liquid
16. Absorber Liquid Pregnant with $CO_2$
17. Absorber Liquid Pregnant with $H_2$
18. Interface Between Gaseous $CO_2$ and Absorber Liquid
19. Interface Between Gaseous $H_2$ and Absorber Liquid
20. Pressure Relief and Control Valve
21. Pressure Relief and Control Valve
22. Gaseous $CO_2$
23. Gaseous $H_2$
24. $CO_2$ Gas Pressure Relief and Flow Control Valve
25. $H_2$ Gas Pressure Relief and Flow Control Valve
26. $CO_2$ Release to Use or Atmosphere
27. $H_2$ Release to Use
28. Absorbant Liquid Reservoir
29. Absorbant Liquid Reservoir
30. Absorbant Liquid Recycle Line to Cathode
31. Absorbant Liquid Recycle Line to Anode
32. Absorbant Liquid Recycle Pump to Anode
33. Absorbant Liquid Recycle Pump to Cathode

PREFERRED EMBODIMENT

The art and science of design of the process which finely divided coal or carbon dust is electrochemically reacted to produce hydrogen gas is taught hereinafter by way of example.

The composite of mevlods consists of an electrolytic cell (41) within which exist an anode (8) and a cathode (9) as electrodes. These electrodes are sheathed by a conductor (10)(36)(11)(37) in order to control the hydraulics of the intermittent flow of a coal (carbon)/-slurry and absorber liquid along the length and width of the electrodes. Working in concert with the electrolytic cell are two gas stripper vessels, one each for the carbon dioxide gas collected by the absorber liquid off of and/or adjacent to the anode; and for the hydrogen gas collected by the absorber liquid off of and/or adjacent to the cathode.

By way of example a group of electrolytic cells is required to process, for instance, 2000 pounds (1-ton) of coal or carbon dust per hour. Those versed in the field of electrochemical cells will have no difficulty designing cell banks or cluster for any rate of coal consumption desired.

Preferably the coal (or carbon dust) is clean washed dust with the smallest diameter possible, ranging from 0.1 micron to 500 micron; and preferably less than 200 micron.

The use of the word coal hereinafter is inferred to also apply to all kinds of carbon dust.

The key to the process is its operation at both superatmospheric pressure and above ambient temperatures. The electro chemical process of converting coal dust to hydrogen is according to well known electro chemical principals that is:

C (solid)+$2H_2O$ (liquid)=$CO_2$ (gas)+$2H_2$ (gas) requiring a theoretical 9.5 kcal per mol of $H_2$ vs. 56.7 kcal for normal electrolysis of water. The principal problem in the past use of this principal for commercial production of hydrogen was the slow rate of reactions. By operating the process under superatmospheric pressure and above ambient temperature along with depolarizing of electrodes, the process is speeded up to where commercialization is warranted.

The use of inert, dielectric liquid or fluid in a liquid state in concert with the coal/water slurry makes it possible to drive the process approximating the theoretical values of power required, and within a time frame acceptable to industry.

The selection of one of the many commercial materials must meet the general requirements as follows: the example hereafter concerns with the halogenated hydrocarbons, commonly called fluorocarbons.

Fluorocarbons are easily made by the reaction of carbon with fluorine.

Removal of hydrogen atoms from the carbon skeleton, either singly or in pairs, is much more easily accomplished than the removal of fluorine atoms. This is a partial explanation of the failure of fluorocarbons to take part in organic chemical reactions. The almost perfect covering power of the fluorine atoms for the carbon skeleton protects the internal force fields and neccessitates a much higher energy of activation to initiate reaction for the fluorocarbons than for hydrocarbons.

Henry's law constants are inversely proportional to solubility on a mol basis. Fluorocarbon liquid dielectrics have a greater solubility for gases components with increasing fluorine saturation. This is demonstrated by the following:

HENRY'S LAW CONSTANTS, ATMOSPHERIC, AT 24° F.

| Solvent | Nitrogen | Oxygen | Argon | Krypton | Xenon |
|---|---|---|---|---|---|
| $CCl_2F_2$ | 420 | 400 | 410 | 230 | 76 |
| $CCl_3F$ | 760 | 530 | 500 | 210 | 62 |
| $C_2FIF_3$ | 340 | 450 | 510 | 360 | 130 |
| $C_2Cl_2F$ | 450 | 410 | 410 | 220 | 72 |
| $C_2Cl_3F_3$ | 650 | 480 | 460 | 200 | 62 |
| $CHClF_2$ | 500 | 410 | 400 | 200 | 65 |
| $CHCl_2F$ | 1100 | 690 | 640 | 230 | 65 |
| $CCl_2F_3$ | 420 | 400 | 410 | 230 | 76 |
| $C_2Cl_2F_4$ | 450 | 410 | 410 | 220 | 72 |
| $C_3Cl_2F_6$ | 460 | 400 | 400 | 210 | 68 |
| $C_4F_{10}$ | 260 | 230 | 230 | 140 | 51 |
| c-$C_4F_8$ | 300 | 250 | 240 | 140 | 47 |

Regular and related solutions, Hildebrand, Prausnitz, and Scott; advise (converted from grams per liter to pounds per 1000 pounds); as follows: (1-atmosphere)

| Solvent | Carbon Dioxide Pounds Per 1000 Pounds Solvent | Nitrogen | Oxygen |
|---|---|---|---|
| $(C_4F_9)_3N$ | 1.46 | 0.134 | 0.072 |
| $C_8F_{16}O$ | 1.95 | 0.181 | 0.093 |

All liquid fluorocarbons, with eight (8) or more carbon atoms, are potential gases absorber liquids. Certain liquid fluorocarbons are more usable than others depending on the particular separation and process operation which takes into account—absorbant capacities, boiling points, critical points, viscosity and other physical/chemical characteristics of the absorbent.

Fluorocarbon gases absorber contact liquid used in this process is one of many such as the group consisting of alkane and cycloalkane derivatives which have at least one fluorine atom; perfluoroamines, including hetrocyclic compounds, and perfluoroethers; including heterocyclic compounds.

Examples, but not limited thereto are the alkane and cycloalkane derivatives—straight chained compounds as $CBrF_3$, $CCl_2F_2$, $CHClF_2$, $C_2Cl_2F_4$, and $C_3Cl_2F_6$. Branched compounds such as $C_5F_{12}$ and cyclic compounds such as c-$C_4F_8$. A perfluoroamine for example could be $(C_4F_9)3_N$ and perfluorether could be $C_3F_7CF_2OCF_2C_3F_7$. An example of a heterocyclic ether absorbent is:

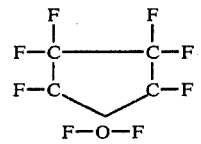

Perfluoro alcohols, ketones, acids and esters of fluorocarbons can be used, but usually less suitable when all properties are considered.

All hydrocarbons can be considered derivatives of methane with hydrocarbon radicals replacing hydrogen atoms. The lack of a measurable dipole moment with hydrocarbons, means that the electric symmetry is not disturbed by replacement of a hydrogen atom with a hydrocarbon radical.

The replacement of the hydrogen atom by a halogen atom as a fluorocarbon radical does, however, introduce a dipole moment. In the fluorocarbon the replacement of a fluorine radical does not change the electric symmetry as indicated by the failure to direct a dipole moment. The replacement of a fluorine atom with a hydrogen atom or hydrocarbon radical does, however, introduce a dipole moment.

It is apparent, therefore, that all hydrocarbons can be considered derivatives of methane; but all fluorocarbons are derivatives of methforane.

Fluorocarbon oxides are not derivatives of water. They are also not ethers. They are properly derivatives of $OF_2$.

Amines are derivatives of ammonia in which one or more of the hydrogen atoms are replaced with organic radicals. Although called amines, there are actually no such structures as fluorocarbon amines, because a fluorocarbon radical attached to a nitrogen atom is a replacement for a fluorine not a hydrogen atom.

The fluorocarbon nitrides, are derivatives of nitrogen trifluoride, not of ammonia.

Derivatives of fluorocarbons are made with fluorocarbon groups attached to almost all other elements other than carbon or fluorine. If the attachment is made to a more electronegative element such as chlorine, oxygen, or nitrogen, a structure results that has a thermal stability and chemical inertness very similar or equal to the fluorocarbon themselves. Fluorocarbons with low electronegative elements attached tend to become less thermally stable and more reactive chemically.

Perfluorocarbons are compounds of carbon and hydrogen in which all the hydrogen atoms attached to the carbon have been replaced by fluorine.

Cyclic fluoroalkylene oxide fluorocarbon compounds, are the cyclic carbon compound which contain only oxygen in addition to the fluorine and carbon. These compounds have a high degree of chemical inertness; they do not burn or react with oxygen, they are colorless; and water insoluble, as well as have an affinity to dissolve gases. Generally these compounds with 6 or more carbon atoms are liquid. The larger the number of carbon atoms in the compound generally the higher the boiling point. The general formula for these compounds is:

$$CF_2(CF_2)_nO$$

where n is an integer having a value of two, three or four.

Compound cyclic fluoroalkylene oxide fluorocarbons are compounds in which one or more of the above are combined to form a single compound. These compounds constitute the family of fully fluoridated analogues of the family of saturated hydrocarbon alkylene oxides, the carbon-oxygen fluorine skeletel structure being the same but all hydrogen atoms being replaced by flourine atoms. Additionally this family of compounds embraces cyclic as well as non-cyclic compounds, and poly as well as mono oxides, all of which have their structural alalogues in the hydrocarbon system of oxides.

Unsymmetrical as well as symmetrical compounds are included. The lack of symmetry may arise from different numbers of carbon atoms in the fluorocarbon group, another type of non symmetry exist when the groups differ as to branching, as when one group is branched and the other are normal straight chains or rings.

All the fluorocarbon tertiary amines contain only carbon, fluorine and nitrogen atoms and each nitrogen atom is directly bonded to three carbon atoms.

These compounds constitute the family of fully fluoridated analogues of the family of saturated hydrocarbon tertiary amines, the carbon-nitrogen skeletal structures being the same but all hydrogen atoms being replaced by fluorine atoms. Additionally, this family of compounds embraces cyclic as well as non-cyclic compounds, and polyamines as well as nonoamines, all of which have their structural analogues in the hydrocarbon system of tertiary amines.

These compounds which contain five or more carbon atoms in the molecule have boiling points about room temperature and hence are liquid. Compounds containing eight or more carbon atoms in the molecule have boiling points near to or above that of water. The following table illustrates the rise in boiling points with increased carbon atoms.

| COMPOUND | B.P. (°C.) |
|---|---|
| $(CF_3)_3N$ | −11 |
| $(C_2F_5)_3N$ | 70 |
| $(C_2F_7)_3N$ | 130 |
| $(C_4F_9)_3N$ | 178 |
| $(C_5F_{11})_3N$ | 218 |
| $(C_6F_{13})_3N$ | 238 |
| $(C_7F_{15})_3N$ | 294 |
| $(C_8F_{17})_3N$ | 321 |
| $(C_{8+X}F_{17+})_3N$ | 321 |

None of the trifluorocarbon amines are water or mineral acid soluble or react chemically with the mineral acids. They all have an affinity for dissolving gases.

This family of tertiary amines includes unsymmetrical as well as symmetrical compounds. The lack of symmetry arises from different numbers of carbon atoms in the various fluorocarbon groups. Another type of non-symmetry exists when the groups differ as to branching, as when one group is branched and the others are normal straight chains or rings.

Fluorocarbons are made which not only include both nitrogen (amines) and oxygen (oxides); but replace one or more of the fluorine atoms with bromine, chlorine, iodines, and one or more of the nitrogen or oxygen atoms with sulphur, phosphorous, mercury, as well as retain some hydrogen atoms.

Those familiar with halogenated hydrocarbons liquids, will have no difficulty in selecting a specific absorber liquid for the combined purpose of absorbing carbon monoxide gas, and hydrogen gas.

Solubility of the absorber liquid is determined for the operating characteristics selected within the electrolytic cell; for example, at 153 apsi and 180° C. (356° F.). Operating pressure is selected which is acceptable to the critical pressure and temperature of the selected absorber liquid, but always in concert where the water in the system remains as liquid water and does not flash to steam.

Although the system can range in operating conditions from ambient and atmospheric pressure up to 600° F., and 1550 apsi, preferably at 153 apsi and 356° F.

The system is filled with water and absorber liquid so the interfaces (14)(15)(59)(60) between the water and the absorber liquid are established in the electrolytic cell. The system is also filled with absorber liquid to fill each gas stripper (49)(50) with gases/absorber liquid interfaces (18)(19) established.

Coal dust, preferably at less than 100 microns is introduced to the water/slurry reservoir at, for example 33.33 pounds per minute along with 100 pounds per minute of water at ambient temperature. In order for the electrolytic cell to pass a current the pH of the coal/water slurry is made slightly alkaline or preferably acidified, between a pH of 4 to 6.999 but preferably to where a current, under the least voltage, flows across the electrodes of 3 amps per square inch of cathode or anode is established or when the voltage applied is 0.05 volts.

Theoretically a voltage of 0.21 is all that is required to convert the coal and water to hydrogen and carbon dioxide, but with polarization such as with regular electrolytic cells of the electrodes it is not uncommon in existing systems to require 2.5 volts.

With the water being broken down to hydrogen and the coal accepting the released oxygen, for example 100 pounds of water a minute is added to the system to replace the water lost by conversion.

Both the coal and water are preferably introduced into the system at not less pressure than the system, for example, 153 apsi.

Recirculation of the coal/water slurry by the slurry transfer pump(s) (5) is adjusted by flow and pressure control valve (42) to produce not less than the stoickiometric quantities of slurry to the electrodes; for example 133 pounds per min.

The coal water slurry is provided principally to the anode (8) by adjustment of flow and pressure control valves (43) and (44). Preferably flow to the anode is not less than 133 pounds per minute.

The coal/water slurry is preferably heated to process operating temperature, for example 180° C. (356° F.) by a heat exchanger (58). For example the requirement for stoichiometric water at 100 pounds per minute requires, for example 40,040 Btu per minute to both retain the system operating temperature at 180° C. and provide for heat losses. Those versed in heating of process and systems will have no difficulty in designing heating systems and providing insulation to assure integrity of the process operating temperature selected.

The absorber liquid is required to recirculate in two separate systems, even though it is a common type material to both systems.

Having determined the gases solubility of the absorber liquid selected at the conditions of operation the absorber liquid is intermittently recirculated at the anode (8) by concert of pumps (32)(51) and control valves (20)(24) to provide not less than 236 pounds per minute to the conductor sheath of the anode. Thus 25% of the carbon dioxide gas formed by the electrochemical action of the coal and water is absorbed. Flow is preferably adjusted to absorb at least 25% of the carbon dioxide produced.

Also the absorber liquid is intermittently recirculated at the cathode (9) by concert of pumps (33)(52) and control valves (21)(25) to provide not less than 472 pounds per minute to the conductor sheath of the cathode. Thus 25% of the hydrogen gas formed by the electrochemical action of the coal and water is absorbed. The intermittent absorber liquid flow is preferably adjusted to absorb at least 25% of the hydrogen produced. Adjustment of absorbed liquid quantities is made to absorb from 1% to 100% of the gases produced, but preferably only 25%.

The absorber liquid is transferred to the gases stripper vessels (49)(59) where the carbon dioxide and hydrogen is removed.

The absorber liquid as removed from the anode and cathode is transferred, in the case of the anode to the carbon dioxide gas stripper (49) and the case of the cathode, to the hydrogen gas stripper (50).

Pressure is reduced on the stripper vessels sufficiently to effervesce the gases from the absorber liquid; thus collecting the gases at the top of the stripper. Product gases are thus removed, for example, $CO_2$ at the rate of 30.55 pounds per minute at the $CO_2$ stripper and $H_2$ at the rate of 2.78 pounds per minute at the hydrogen stripper. Those versed with the stripping of gases from liquids will have no difficulty in selecting and designing the gases stripping apparatus.

The balance of the $CO_2$ is removed under operating pressure by valve (63) direct from the anode (8) compartment (61) of the electrolytic cell (41) at the rate, for example of 91.72 pounds per minute. The balance of the hydrogen production is recovered under operating pressure through valve (64) direct from the cathode (8) compartment (62) of the electrolytic cell (41) at the rate, for example of 8.34 pounds per minute.

The electrodes are of material and configuration normal to the electrolysis industry with the exception of the conductors which confine the electrolyte in this example the acidified coal/water slurry and the absorber liquid. The conductor is designed to produce an intimate contact on the electrodes of coal water slurry intermittent washing of electrodes by the absorbent liquid at a velocity which will not only depolarize the gases $CO_2$ and $H_2$ collecting on the anode and cathode, but absorb out of the liquids gases as produced, at instant of contact with the electrodes. Velocity ranges from one inch (1") per second to 120 inches are usable, but preferably 24 inches per second.

While the disclosure of this invention has been described in a certain degree of particularity, it is understood that the disclosure has been made by way of example and that changes in coal/water slurry percentages, acidity of electrolyte, quantities and specifications for absorber liquid, operating temperatures and pressures, and other process changes as well as details of cell(s) configuration, gases collection and stripping, may be made without departing from the spirit thereof.

What is claimed:

1. I claim a combination of processes as a single process for use with coal or carbon dust and their particulates and their electro-chemical reaction with water for the express purpose of producing hydrogen; consisting of:

reducing coal or carbon to particles smaller than 500 micron or as small as practical, blending the coal or carbon dust with water to produce a ten percent to eighty percent coal slurry (by weight), introducing the coal (carbon) slurry to a slurry supply reservoir under superatmospheric pressure, transferring the coal (carbon)/slurry through a heater or heat exchanger, increasing its temperature, then passing the coal (carbon) slurry through electrolyte cell conductor tubes or retaining devices which both mixes the slurry and intermitantly passes a gaseous absorber liquid therein controlling the velocity of both liquids across the anode and across the cathode electrode, thus depolarizing the electrodes in an electro-chemical cell which by nonmiscible physical and gravity separation keeps separated the coal (carbon) slurry from the absorber liquid, as well as free gases of $CO_2$ and $H_2$, the carbon dioxide ($CO_2$) pregnant absorber liquid and frees $CO_2$ at the anode, the hydrogen ($H_2$) pregnant absorber liquid, and frees $H_2$ at the cathode, recycling the spent coal (carbon)/slurry from both the anode and cathode back to the coal (carbon)-/water slurry reservoir, at the same time removing the absorber liquid pregnant with $CO_2$ absorbed at the anode from the electrolysis system to the $CO_2$ stripper, and the absorber liquid pregnant with $H_2$ stripper, then reducing the operating pressure within both the $CO_2$ and $H_2$ stripper causing effervescence and thus release of both $CO_2$ and $H_2$ respectively, and their individual recovery, recycling the gases freed absorber liquid from both strippers back to the electrolytic cell "conductor" tubes, recovering the $CO_2$ for use or disposal to atmosphere from both electrolytic cell at anode and $CO_2$ stripper, recovering the $H_2$ for use from both electrolytic cell at cathode, and stripper.

* * * * *